US009487039B2

(12) United States Patent
Casals et al.

(10) Patent No.: US 9,487,039 B2
(45) Date of Patent: Nov. 8, 2016

(54) PRINTER

(75) Inventors: Marc Rossinyol Casals, Berga Barcelona (ES); Jacint Humet Pous, Santa Perpetua de Mogoda Barcelona (ES); Maria Elizabeth Zapata, Barcelona Rubi (ES); Jaime Fernández del Rio, Calella Barcelona (ES)

(73) Assignee: HEWLETT-PACKARD DEVELOPMENT COMPANY, LP., Houston, TX (US)

( * ) Notice: Subject to any disclaimer, the term of this patent is extended or adjusted under 35 U.S.C. 154(b) by 489 days.

(21) Appl. No.: 13/229,186

(22) Filed: Sep. 9, 2011

(65) Prior Publication Data

US 2013/0061767 A1 Mar. 14, 2013

(51) Int. Cl.

| | |
|---|---|
| ***B41F 1/40*** | (2006.01) |
| ***B41M 1/14*** | (2006.01) |
| ***B41J 2/21*** | (2006.01) |
| ***B41J 11/00*** | (2006.01) |

(52) U.S. Cl.
CPC ..... *B41M 1/14* (2013.01); *B41J 2/2114* (2013.01); *B41J 11/0015* (2013.01)

(58) Field of Classification Search
CPC ..... B41M 1/14; B41J 11/0015; B41J 2/2114
USPC ..... 101/202; 347/165
See application file for complete search history.

(56) References Cited

U.S. PATENT DOCUMENTS

| | | | | |
|---|---|---|---|---|
| 6,435,639 | B1 * | 8/2002 | Nakajima et al. | 347/15 |
| 6,474,778 | B1 * | 11/2002 | Koitabashi et al. | 347/43 |
| 6,877,850 | B2 | 4/2005 | Ishimoto et al. | |
| 7,033,013 | B2 | 4/2006 | Koyano et al. | |
| 7,338,143 | B2 | 3/2008 | Onishi et al. | |
| 7,645,019 | B2 | 1/2010 | Hirakawa | |
| 7,661,786 | B2 * | 2/2010 | Nakazawa et al. | 347/14 |
| 7,682,015 | B2 | 3/2010 | Hoshino | |
| 8,180,230 | B2 | 5/2012 | Klassen | |
| 2005/0219294 | A1 * | 10/2005 | Nakazawa et al. | 347/14 |
| 2006/0203019 | A1 | 9/2006 | Yamanobe | |
| 2007/0064026 | A1 * | 3/2007 | Hirakawa | 347/6 |
| 2008/0241397 | A1 | 10/2008 | Kato et al. | |
| 2008/0285990 | A1 | 11/2008 | Nishizawa | |
| 2009/0321979 | A1 | 12/2009 | Hiraide | |
| 2010/0080911 | A1 | 4/2010 | Okada | |
| 2010/0093725 | A1 | 4/2010 | Ku et al. | |
| 2011/0007359 | A1 | 1/2011 | Yamakawa | |
| 2011/0242556 | A1 | 10/2011 | Jinno et al. | |
| 2013/0061767 | A1 | 3/2013 | Casals et al. | |

FOREIGN PATENT DOCUMENTS

| | | |
|---|---|---|
| JP | 2006272934 4 | 10/2006 |
| WO | WO-2011021591 | 2/2011 |

* cited by examiner

*Primary Examiner* — Matthew G Marini
(74) *Attorney, Agent, or Firm* — HP Inc—Patent Department

(57) ABSTRACT

Certain examples of printers and methods of printing may involve determining colorant amounts of image regions within a print image.

12 Claims, 4 Drawing Sheets

PRINTER

BACKGROUND

Treatment fluids may be applied to a surface of a substrate before and/or after printing for improved processing of colorants on a substrate. In particular know examples, a pre-treatment fluid is placed onto the print substrate before printing to control a bonding and hardening of the colorants. Sometimes post-treatment fluids are used, for example over a printed image. The post-treatment fluids may provide for a coating or the like over the printed image.

BRIEF DESCRIPTION OF THE DRAWINGS

For the purpose of illustration, certain examples of the present invention will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that also examples or elements that are not literally disclosed may be derived from the description and drawings by a person skilled in the art.

Figure 1:
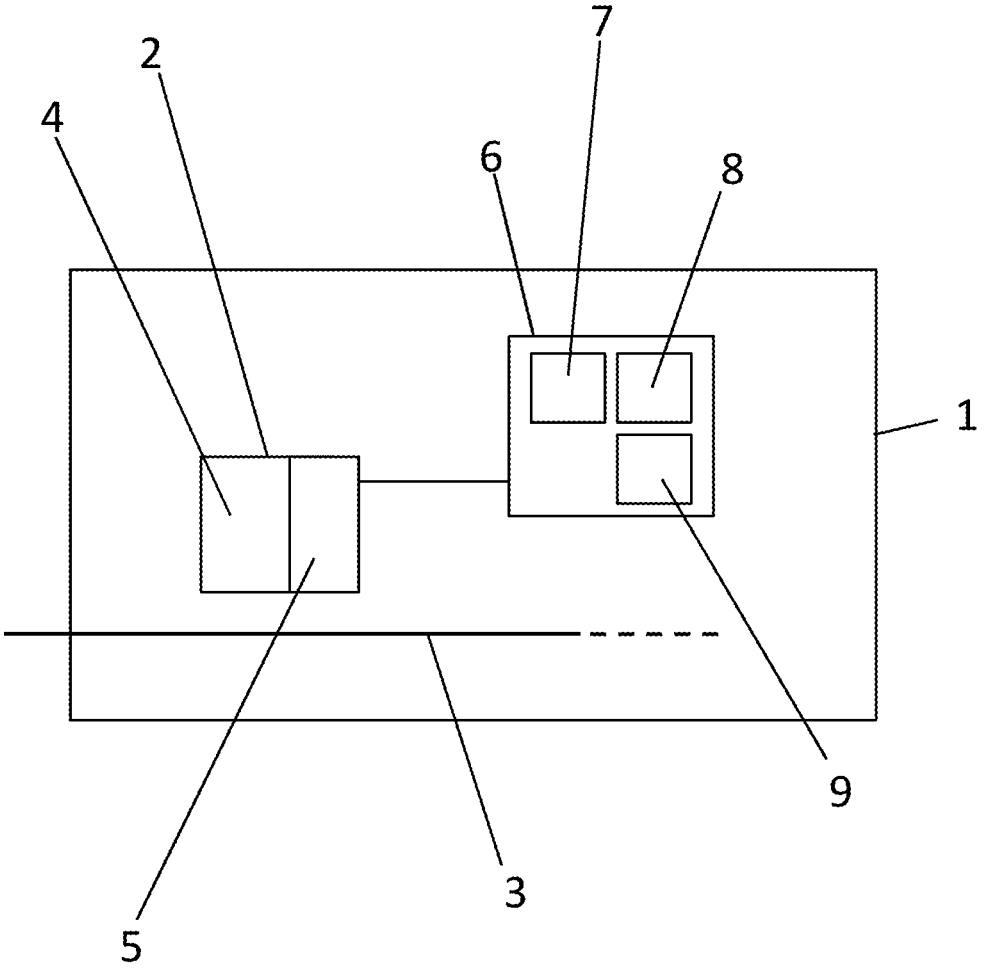
FIG. 1 shows a diagram of an example of a printer in side view.

FIG. 1 shows an example of a printer 1. In the shown example, the printer 1 comprises an application device 2 for applying fluid onto a substrate 3. The application device 2 comprises a colorant application device 4 and a treatment fluid application device 5. The colorant application device 4 is arranged to apply colorant to the substrate 3 for printing an image. The colorant may comprise any type of colorant, for example at least one of any type of ink, toner, dye, wax, etc., for example UV-curable, pigment and/or latex ink or monomer-based ink.

The printer 1 may be any of an inkjet printer 1, laser printer, digital press, webpress, etc. The application device 2 may include a fluid ejection printhead. The application device 2 may include a scanning and/or a page wide array printhead.

The treatment fluid application device 5 is arranged to apply treatment fluid to the substrate 3. The treatment fluid application device 5 is arranged to vary amounts of treatment fluid over different regions of a print image. In an example, an amount of treatment fluid may be interpreted as a drop amount of the treatment fluid that is applied to a particular surface area of the substrate 4. In other examples, the amount of treatment fluid may be indicated by an estimated average thickness of a treatment fluid layer, for example a thickness in microns or millimeters. In again other examples, the amount of treatment fluid may be indicated in weight per surface area, and/or applied fluid volume per surface area. In again a further example the treatment fluid amount may be indicated in resolution or dots per surface area, which may in certain instances correspond to the fired drop amount. An illustration of different indications of the same treatment fluid amount, that should not be construed to be limiting in any way, is for example 0.48 drops per pixel at a 600 dots per inch resolution, which could for example be equal to 172800 drops per square inch of substrate 4, or for example 0.26 grams per square meter.

In one example, the treatment fluid includes pretreatment fluid. For example, the pre-treatment fluid is configured to treat a surface of the substrate 3 before printing. The treatment fluid application device 5 may comprise a fluid ejection device such as a printhead, or a roller, sprayer or other suitable device. By applying the pretreatment fluid coalescence and/or bleed of the colorants on the substrate 3 may be better controlled. By applying the pretreatment fluid a certain control of an interaction between the colorant and the substrate 3 and/or between colorants may be achieved. Other effects of the pretreatment fluid may include controlling a hardening of the colorants, controlling a fixing of the colorant to the substrate 3, influencing a durability of the printed image on the substrate 3, influencing a gloss effect, influencing a texture of the printed image, and/or other effects.

In another example, the treatment fluid includes a post-treatment fluid. For example, the post-treatment fluid is configured to be applied over the surface of the substrate 3 and the printed image after printing, to provide certain effects that may include bonding the colorant, controlling an interaction between the colorant and the substrate 3, facilitating a curing of the colorant, facilitating a fixing of the colorant to the substrate 3, influencing a durability of the printed image on the substrate 3, influencing a gloss effect, and/or other effects. The post-treatment fluid may provide for a coating over the printed image. In an example both pretreatment and post-treatment fluids are used.

The printer 1 further includes a printer circuit 6. In an example the printer circuit 6 includes a control circuit 7, for example for driving the application device 2, media advance systems, motors, etc. In an example, the printer circuit 6 includes a formatter 8 for processing image data that is entered into the printer 1. For example, the formatter 8 may include a RIP (Raster Image Processor) for converting incoming image data to a raster image and/or to a halftone image. For example, the formatter 8 may be configured to convert the image to printable digital image data such as a halftone image and/or a CMYK pixel set. The digital image processed by the formatter 8 may be used by the control circuit 7 for determining colorant characteristics and other characteristics for printing the printed image, such as for example colorant amounts, colorant colors, colorant color sequences, colorant color combinations and their locations. From the processed image data also other data may be derived such as for example pass characteristics. The control circuit 7 is configured to instruct the application device 2 according to the processed digital image data, for printing the image. In a further example, the printer circuit 6 includes a memory arrangement 9. The memory arrangement 9 may for example store one or more LUTs (Look Up Tables) that may associate certain colorant characteristics or other characteristics with treatment fluid amounts.

In an example of this disclosure, the printer circuit 6 is configured to (i) process incoming digital image data for printing an image on a substrate 3, (ii) from the digital image data, determine colorant amounts of different image regions within the print image (see FIG. 4), (iii) set the treatment fluid amounts for the different image regions at least partially based on the colorant amounts in the respective image regions, and (iv) instruct the treatment fluid application device to apply the set treatment fluid amounts. In one example, the colorant amounts may be determined from a halftone image.

Figure 2:
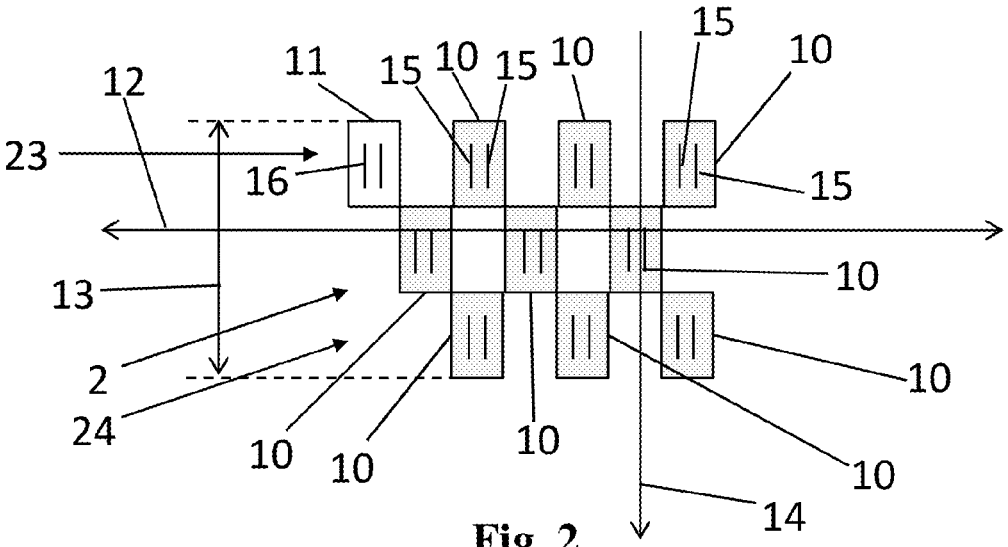
FIG. 2 shows a diagram of an example of a scanning device in top view.

FIG. 2 shows an example of an application device 2 for an inkjet printer 1. The application device 2 may be a scanning device 2. In the shown embodiment, the application device 2 includes an array 24 of fluid ejection devices 10, 11, for example including a first fluid ejection device and a second fluid ejection device 10, 11. The first fluid ejection devices 10 include colorant nozzle arrays 15 for ejecting colorant. For example, the fluid ejection devices 10 include resistor actuators for ink ejections, such as thermal inkjet actuators or piezo-inkjet actuators. The applied colorant may include a monomer-based ink, such as latex, pigment and/or UV curable ink. The second fluid ejection device 11 may be a treatment fluid application device 5 for treating the substrate 3. The second fluid ejection device 11 may be a pre-treatment fluid application device for treating the substrate 3 before printing. The second fluid ejection device 11 may include treatment fluid nozzle arrays 16 for ejecting the treatment fluid onto the substrate 3. The second fluid ejection device 11 and the treatment fluid nozzle arrays 16 may be arranged in the leading row 23 of the fluid ejection devices 10, 11, wherein the leading row is defined by the media advance direction 14.

In an example the application device 2 is arranged to scan over a width of the substrate 3 in a scanning direction 12. The shown application device 2 has a swath width 13. The scanning direction 12 is perpendicular to a media advance direction 14. As can be seen, the second fluid ejection device 11 may be positioned in the array of fluid ejection devices 10, 11 so as to eject the treatment fluid onto the surface of the substrate 3 before the colorant is ejected onto the substrate 3 by the first fluid ejection devices 10 during the same pass over the substrate 3. In an example, the colorant nozzle arrays 15 and treatment fluid nozzle arrays 16 are arranged at a distance from each other to prevent reaction between colorant and treatment fluid near or in the nozzle arrays 15, 16.

In an example, a distance and/or location of the treatment fluid nozzle array 16 with respect to the colorant nozzle arrays 15 may influence the timing and amount of treatment fluid ejection. For example, a direction of a pass may influence the amount of treatment fluid ejection. Also other pass characteristics and/or a colorant configuration of the particular image region 21A-H over which the array 24 passes may influence a timing and amount of treatment fluid.

Figure 3:
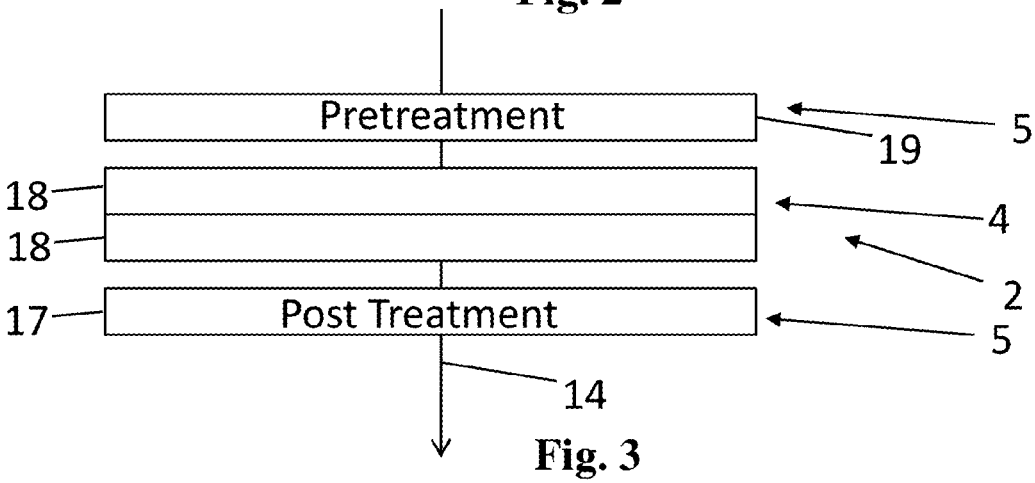
FIG. 3 shows a diagram of an example of a page wide array fluid application device in top view.

FIG. 3 shows an application device 2 according to a further example of this disclosure, including a colorant application device 4 and a treatment fluid application device 5, with the media advance direction 14. The shown example includes a page wide array pre-treatment fluid application device 17, one or more page wide array colorant ejection devices 18, and a page wide array post-treatment fluid application device 19.

Figure 4:
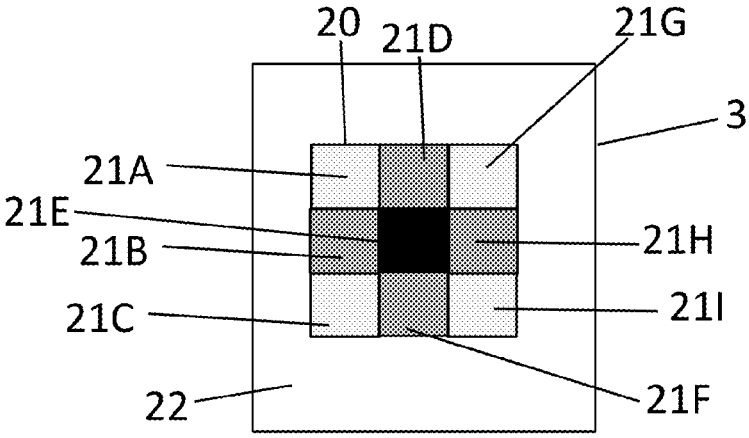
FIG. 4 shows a diagram of an example of a substrate with a printed image.

FIG. 4 shows a substrate 4 with a print image 20. For example, the shown print image 20 may represent a printed image, or a virtual (digital) reflection of the printed image such as a bitmap or halftone instance of the print image 20. The digital reflection of the printed image may be represented by the input digital image data, from which the various colorant properties may be determined before printing. The image regions 21A-I may be defined by surface areas. The image regions 21A-I may have equal surface areas. In the shown example, the print image 20 has nine image regions 21A-I of equal surface dimensions. For example, an image region 21A-I is defined in dots, pixels, square millimeters, square centimeters, square inches, etc. A print image 20 may consist of at least two image regions 21A-I. The shown example print image 20 has nine image regions 21A-I while in other examples the print image 20 may have hundreds or thousands of image regions 21A-I. For example, around a printed instance of the print image 20, a colorant free zone 22 of the substrate 3 may be provided. The image regions 21A-I are not part of the colorant free zone 22 around the print image 20.

In one example, it may be advantageous to adjust an amount of treatment fluid per image region 21A-I to an amount of colorant of each respective image region 21A-I. For example, the different image regions 21A-I may have different colorant amounts according to the resulting desired print colors. Consequently, the image regions 21A-I having different colorant amounts may require different amounts of treatment fluid, for example for achieving a certain coalescence, bleed, gloss, or other effect, in the respective image regions 21A-I. The control circuit 7 is configured to instruct the treatment fluid application device 5 to apply treatment fluid amounts as corresponding to the determined colorant amounts in the respective image regions 21A-I.

In an example a LUT may be used that is stored in the memory arrangement 9. The LUT may associate certain colorant threshold values or ranges to corresponding treatment fluid amounts. The printer circuit 6 may refer to the LUT for determining the treatment fluid amount per image region 21A-I, based on the colorant amount and/or another characteristic.

In a further example, it may be advantageous to base an amount of treatment fluid on a particular colorant color or colorant color combination. Certain colorant colors or configurations of combined colorant colors may require different treatment fluid amounts than other colorant colors or colorant color combinations. For example, a desired treatment fluid amount may be different for Cyan than for Magenta. For example, a desired treatment fluid amount may be different for 50% AC (area coverage) Cyan and 50% AC Magenta, than for 30% AC Yellow and 30% AC Magenta and 40% AC black. Therefore, in an example the printer circuit 6 is configured to determine specific colorant colors for the respective image regions 21A-I, from the processed digital image data, and set the treatment fluid amounts at least partially based on the determined colorant colors for the respective image regions 21A-I. In a further example the printer circuit 6 is configured to determine certain configurations of colorant color combinations for the respective image regions 21A-I, from the processed digital image data, and set the treatment fluid amounts corresponding to the determined configurations of colorant color combinations in the respective image regions 21A-I.

In a further example, it may be advantageous to determine a treatment fluid amount per image region 21A-I to a particular sequence of applied colorant colors. For example, different colorant sequences may have different coalescence properties, bleed properties, gloss effects, etc. For example, the printer circuit 6 is configured to determine sequences with which the colorant colors are applied to the substrate 4 in each respective image region 21A-I, and set amounts of treatment fluid at partially based on the respective colorant color sequences.

As explained, different coalescence and/or bleed properties of the colorants may coexist within one printed image 20. To achieve a certain control over the coalescence and/or bleed properties of the colorants on the substrate 3 the treatment fluid amounts may be dosed over the entire printed image 20, corresponding to the estimated coalescence and/or bleed properties of the colorants in the respective image regions 21A-I. In certain examples, certain degrees of coalescence and/or bleed may be estimated by determining colorant amounts, colorant types or colors, colorant combinations, colorant sequences, but also for example substrate type, pass characteristics, etc. In other examples, certain degrees of coalescence and/or bleed properties pertaining to images, colorants, substrates, etc. are known and stored in an accessible memory such as the memory arrangement 9. In an example, the circuit 6 is configured to determine a degree of coalescence of the colorants in the different image regions 21A-I, and set the treatment fluid amounts at least partially based on the degree of coalescence and/or bleed in the respective image regions 21A-I.

In one example the application device 2 comprises a scanning device. In an example, the treatment fluid application device 5 is arranged to apply the treatment fluid during a print pass. The printer circuit 6 may be configured to determine a number of passes over an image region 21A-I, wherein the treatment fluid amount for the respective image region 21A-I is set at least partially based on the determined number of passes over the image regions 21A-I. For example, the amount of treatment fluid to be applied to a respective image region 21A-I may be at least partially based on an ordinal pass number of a respective pass. For example, depending if its a first, second, third, or other pass over the same image region 21A-I, the appropriate treatment fluid amount may be determined. For example, the amount of treatment fluid may set at least partially based on a scanning direction 12 of the respective pass. Depending on the scanning direction 12, the appropriate amount of treatment fluid may be determined. In a further example, the treatment fluid amount may be set at least partially based on the total number of passes over the respective image region 21A-I. Depending on the total number of passes, the appropriate amount of treatment fluid may be determined.

In a further example, the printer circuit 6 is configured to determine a pass speed of the application device 2 over the respective image region 21A-I, during a scanning action, and set the treatment fluid amount in the respective image region 21A I at least partially based on the pass speed. Depending on a respective pass speed of the application device 2, an appropriate treatment fluid amount may be determined, and applied.

In a further example, absorption characteristics of the substrate 3 may influence certain properties of the printed colorants, such as for example coalescence, bleeds, gloss level, texture, etc. In different examples, the absorption characteristic may relate to porosity (i.e. sizes and amounts of pores), material, fiber configurations, substrate weight per surface area, thickness per surface area, etc. It may be advantageous if the printer circuit 6 is configured to determine an absorption characteristic of the substrate 3. For example, the absorption characteristic of substrate 3 can be determined through operator input and/or an optical sensor and/or digital image pattern recognition. The printer circuit 6 is configured to set the treatment fluid amount at least partially based on the absorption characteristic of the substrate 3.

In an example, the printer circuit 6 is configured to determine the substrate type and colorant amounts for respective image regions 21A-I. The treatment fluid amount to be applied to the substrate 3 may be set at least partially based on the determined substrate type and the colorant amounts for the respective image regions 21A-I. For example, each substrate type may be associated to a particular LUT that associates colorant amounts to treatment fluid amounts, or one LUT may associate substrate types and colorant amounts to treatment fluid amounts.

In an example, an applied pretreatment fluid amount influences a gloss level of the printed product. In an example, the printer circuit 6 is configured to determine a desired gloss level of the image. For example, the desired gloss level may be determined using the input digital image data and/or operator input. The printer circuit 6 may be configured to dose the pretreatment fluid amount that is to be applied to the respective image regions according to the desired gloss level. The printer circuit 6 may be configured to include also other print variables for dosing the treatment fluid amount. Such other print variables may include substrate characteristics, colorant amounts, colorant sequences, colorant combinations, colorant types, coalescence properties, etc.

Figure 5:
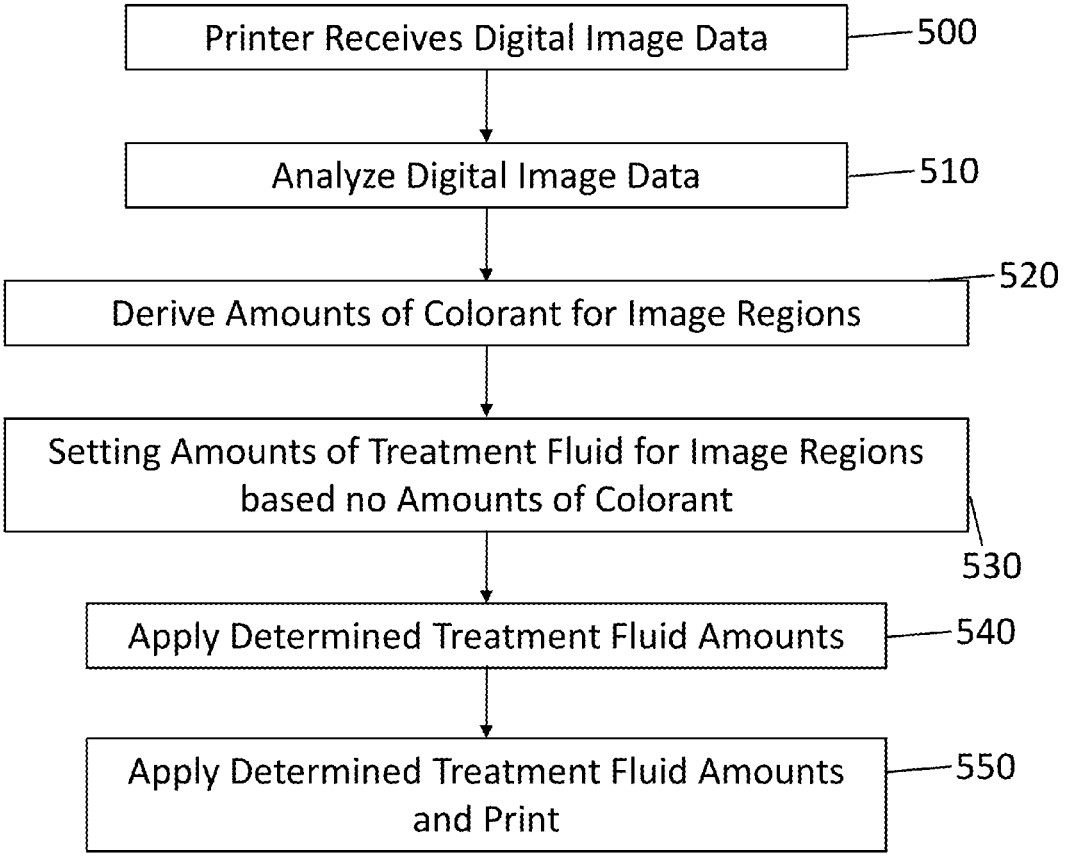
FIG. 5 shows a flow chart of an example of a method of printing.

FIG. 5 shows an example of a method of printing. For example, the method includes receiving digital image data (block 500), for example by a printer 1 through a connected network or data carrier. For example, the method includes processing and analyzing the digital image data for printing (block 510). For example, the control circuit analyzes a digital image, for example a bitmap or a halftone image, for determining certain colorant characteristics for each image region 21A-I of the print image 20. The method includes deriving from the digital image data, for each image region 21A-I of the printed image, amounts of colorant for printing (block 520). The method includes determining the treatment fluid amounts for the image regions 21A-I, at least partially based on the respective colorant amounts, for example using at least one LUT (block 530). The method includes applying the determined treatment fluid amounts to the respective image regions 21A-I on the substrate 3 (block 540), and at the same time, printing. In an example, colorant amounts vary over the print image 20, so that different treatment fluid amounts are applied per image region 21A-I.

Figure 6:
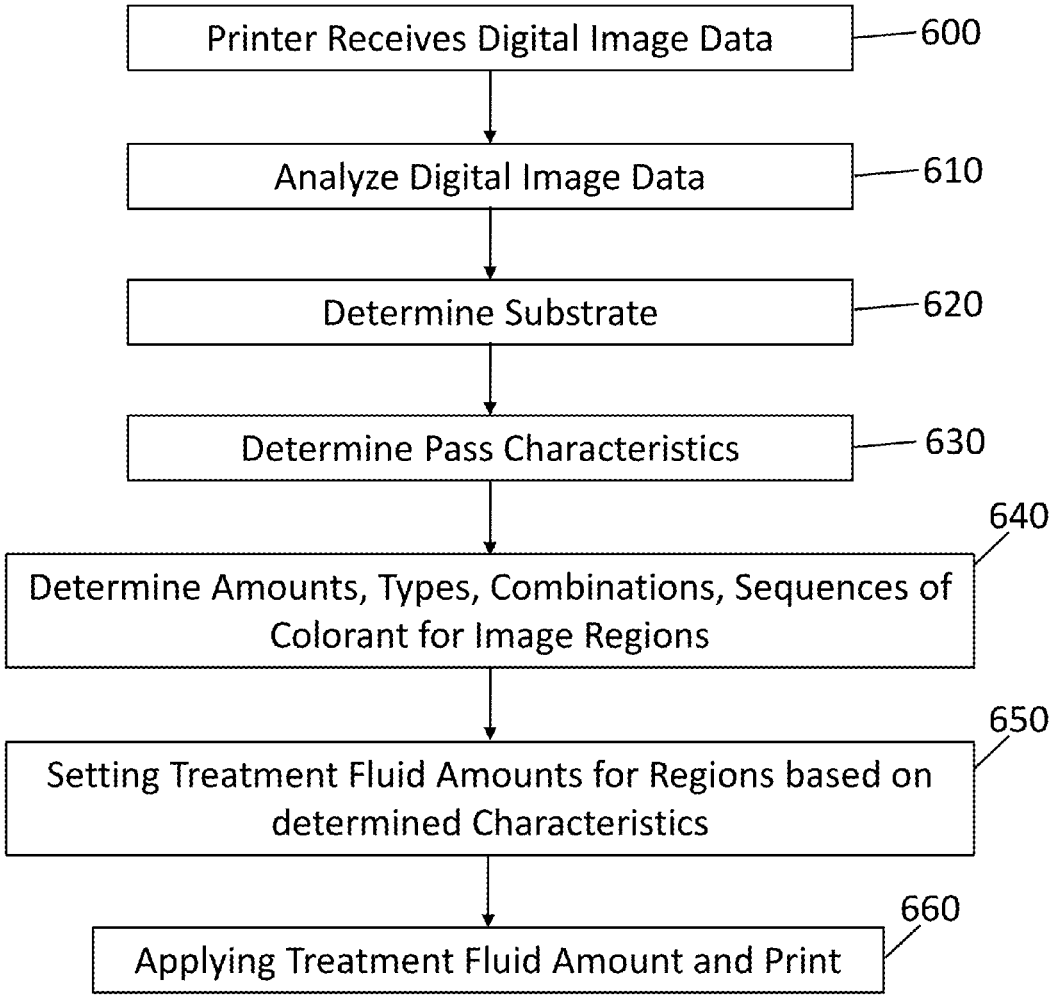
FIG. 6 shows a flow chart of another example of a method of printing.

FIG. 6 shows another example of a method of printing. For example, the method includes receiving digital image data (block 600), for example by a printer 1 through a connected network or data carrier. For example, the method includes processing and analyzing digital image data for printing (block 610). For example, the input image data may be converted to printable image data such as a halftone image, which in turn may be analyzed for colorant and pass characteristics. For example, the method includes (i) determining a substrate type (block 620), for example from the digital image data and/or through operator input. For example, determining the substrate type may include determining a certain colorant absorption characteristic of the substrate 3. For example, the method includes (ii) determining a gloss level. For example, a gloss level may be included in the input image data or may be indicated by an operator. For example, the method includes (iii) determining pass characteristics of the application device 2 (block 630). For example, the pass characteristics are obtained by analyzing the image data (see block 610). For example, the pass characteristics may be different for different image regions 21A-I. For example, the method includes determining (iv) amounts of colorant, (v) types of colorant, such as color or ink types, (vi) configurations of colorant color combinations, (vii) sequences of applications of colorants, and/or for each respective image region 21A-I (block 640), for example by analyzing the image data (see block 610). For example, the method includes setting a treatment fluid amount for each respective image region 21A-I based on at least one of said (i) substrate type, (ii) pass characteristics, (iii) amounts of colorant, (iv) types of colorant, (v) configurations of colorant color combinations, (vi) sequences of application of colorants, and (vii) gloss levels (block 650). For example, the method includes applying the set treatment fluid amounts to the respective image regions 21A-I of the substrate 3 (block 660) while printing. In an example, the treatment fluid and colorant are applied to the substrate 3 at the same time, for example during the same pass. In a further example, the treatment fluid is ejected onto the substrate 3 through nozzles 16 that are arranged at a distance from the nozzles 15 that eject the colorant.

Certain examples of this disclosure may involve setting a treatment fluid amount based on a desired effect, for example a gloss level, bleed, coalescence, texture or other effects. Other examples of this disclosure may involve setting a treatment fluid amount based on certain colorant properties such as amounts, types, colors, combinations, sequences, applications speed, etc. Further examples may set treatment fluid amounts based on both colorant properties and desired effects. The treatment fluid amounts may be dynamically adjusted over the various image regions 21A-I. The treatment fluid amounts may be calculated in drops per surface area, for example drops per square inch, but any other suitable unit may be chosen.

In an example, the colorant includes a monomer based ink such as latex ink. In a further example, pretreatment fluid is used for preparing the substrate 3 for the monomer based ink. The pretreatment fluid amounts may be dynamically varied over the substrate 3 at least partially based on colorant and substrate characteristics as described in this disclosure. An advantage may be that the pretreatment fluid may be used more efficiently. Another advantage may be that a control over bonding, drying, hardening, coalescence, bleed and/or curing of the ink may be achieved. A further advantage may be that other effects such as gloss and/or texture may be controlled.

The above description is not intended to be exhaustive or to limit this disclosure to the examples disclosed. Other variations to the disclosed examples can be understood and effected by those skilled in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. A printer comprising:

a colorant application device to apply colorant to a substrate at each of different image regions;

a treatment fluid application device to apply treatment fluid to the substrate at each of the different image regions; and a circuit to process incoming digital image data for printing an image on the substrate, to determine an amount of the colorant to apply to each of the different image regions within the image via the colorant application device based on the digital image data, to determine colorant colors in the image regions, and to selectively set an amount of the treatment fluid for each of the different image regions at least partially based on a sequence of application of the colorant colors, and to instruct the treatment fluid application device to apply the set amount of the treatment fluid to the substrate, wherein the colorant application device and the treatment fluid application device are part of a scanning carriage, wherein the treatment fluid application device and the colorant application device are arranged to apply the treatment fluid and colorant, respectively, during a same print pass, and wherein the circuit is further to determine a pass speed over the different image regions, and to selectively set the amount of the treatment fluid for the respective image region at least partially based on the pass speed.

2. The printer according to claim 1, wherein the circuit is further to determine a configuration of a colorant color combination for each of the different image regions, and to selectively set the amount of the treatment fluid in each of the different image regions at least partially based on the configuration of the colorant color combination in each of the respective different image regions.

3. The printer according to claim 1, wherein the colorant application device and the treatment fluid application device are part of a scanning carriage, wherein the treatment fluid application device and the colorant application device are arranged to apply the treatment fluid and colorant, respectively, during a print pass of a plurality of print passes, and wherein the circuit is further to determine a number of the plurality of print passes over an image region, and to selectively set the amount of the treatment fluid for the respective different image regions at least partially based on at least one of an ordinal pass number of a respective pass of the plurality of print passes, a pass direction of a respective pass of the plurality of print passes, and a number of the plurality of print passes over the respective different image regions.

4. The printer according to claim 3, comprising a scanning fluid application device array, arranged to eject colorant and treatment fluid in the same pass, wherein colorant ejection nozzles and treatment fluid nozzles are arranged at a distance from each other to prevent reaction between colorant and treatment fluid near or in the nozzles.

5. The printer according to claim 1, wherein the circuit is to determine an absorption characteristic of the substrate that is used for printing the image via an optical sensor, and to selectively set the amount of the treatment fluid at least partially based on the absorption characteristic of the substrate.

6. The printer according to claim 1, wherein the circuit is further to determine a substrate type associated with the substrate, and to selectively set the amount of the treatment fluid to be applied, for each of the respective different image regions, at least partially based on the substrate type and colorant amounts for the respective image regions.

7. The printer according to claim 1, wherein the treatment fluid application device comprises a pretreatment fluid application device, and wherein the circuit is to determine a desired gloss level of the image, and to selectively set the pretreatment fluid amount at least partially based on the desired gloss level.

8. The printer according to claim 1, further comprising a memory arrangement storing a LUT (Look Up Table) comprising treatment fluid amounts associated to at least one of different colorant amounts, different substrate types, different types of colorant, different combinations of colorant colors, different sequences of application of colorant colors, and different image gloss levels wherein the circuit is configured to determine at least one of a colorant amount, a substrate type, types of colorants, combinations of colorant colors, sequences of application of colorant colors, and an image gloss level and refer to the LUT for determining the corresponding amount of the treatment fluid.

9. The printer according to claim 1, the treatment fluid comprising a pretreatment fluid.

10. The printer according to claim 1, wherein the printer comprises a scanning carriage, wherein the circuit is to selectively set the amount of the treatment fluid for the different image regions at least partially based on a pass characteristic of a scanning carriage.

11. The printer according to claim 10, further comprising a memory arrangement storing a LUT (Look Up Table) comprising treatment fluid amounts associated to different pass characteristics, wherein the circuit is configured to determine the pass characteristics and refer to the LUT for determining the corresponding amount of the treatment fluid.

12. A printer comprising:

a colorant application device to apply colorant to a substrate at each of different image regions;

a treatment fluid application device to apply treatment fluid to the substrate at each of the different image regions, wherein the colorant application device and the treatment fluid application device are part of a scanning carriage, wherein the treatment fluid application device and the colorant application device are arranged to apply the treatment fluid and colorant, respectively, during a same print pass; and a circuit to process incoming digital image data for printing an image on the substrate, to determine an amount of the colorant to apply to each of the different image regions within the image via the colorant application device based on the digital image data, to determine a pass speed over the different image regions, and to selectively set the treatment fluid amount for the respective different image regions at least partially based on the pass speed.

* * * * *